US007331321B2

(12) United States Patent
Thompson

(10) Patent No.: US 7,331,321 B2
(45) Date of Patent: Feb. 19, 2008

(54) HANDHELD ELECTRIC STARTER FOR ENGINES AND METHOD OF USE

(76) Inventor: Gene Thompson, 305 Hillabee Rd., Ramer, AL (US) 36069

( * ) Notice: Subject to any disclaimer, the term of this patent is extended or adjusted under 35 U.S.C. 154(b) by 0 days.

(21) Appl. No.: 11/473,235

(22) Filed: Jun. 23, 2006

(65) Prior Publication Data

US 2007/0000466 A1 Jan. 4, 2007

Related U.S. Application Data

(60) Provisional application No. 60/811,427, filed on Jun. 7, 2006, provisional application No. 60/695,530, filed on Jul. 1, 2005.

(51) Int. Cl.
*F02N 11/12* (2006.01)

(52) U.S. Cl. ..... 123/179.24; 123/179.25

(58) Field of Classification Search ..... 123/179.24, 123/179.25, 185.3; 74/6

See application file for complete search history.

(56) References Cited

U.S. PATENT DOCUMENTS

| | | | | | |
|---|---|---|---|---|---|
| 2,475,750 | A * | 7/1949 | McCormick et al. | ..... | 318/447 |
| 3,219,021 | A * | 11/1965 | Mercer et al. | ..... | 123/179.24 |
| 3,596,647 | A | 8/1971 | Heisler | | |
| 3,718,129 | A | 2/1973 | McKee | | |
| 4,615,311 | A * | 10/1986 | Scheckel | ..... | 123/179.24 |
| 4,848,288 | A * | 7/1989 | Murase et al. | ..... | 123/179.24 |
| 4,884,535 | A * | 12/1989 | Iida et al. | ..... | 123/179.24 |
| 4,909,200 | A * | 3/1990 | Sumi | ..... | 123/179.24 |
| 4,930,467 | A * | 6/1990 | Masuda et al. | ..... | 123/179.24 |
| 5,078,104 | A * | 1/1992 | Peterson, Jr. | ..... | 123/179.24 |
| 5,285,693 | A | 2/1994 | Sanders et al. | | |
| 5,826,555 | A * | 10/1998 | Aronsson et al. | ..... | 123/185.3 |
| 6,240,889 | B1 * | 6/2001 | Kuwabara et al. | ..... | 123/179.24 |
| 6,253,722 | B1 * | 7/2001 | Robinson et al. | ..... | 123/179.24 |
| 6,374,791 | B1 * | 4/2002 | Kuwabara et al. | ..... | 123/179.25 |
| 6,679,217 | B2 * | 1/2004 | Nieda et al. | ..... | 123/185.14 |
| 6,722,336 | B2 * | 4/2004 | Nieda et al. | ..... | 123/185.14 |
| 6,837,202 | B1 * | 1/2005 | Lu | ..... | 123/179.27 |
| 2002/0092493 | A1 * | 7/2002 | Iida et al. | ..... | 123/179.24 |
| 2004/0244754 | A1 | 12/2004 | Smith | | |
| 2004/0255890 | A1 * | 12/2004 | Tsutsumi et al. | ..... | 123/179.24 |
| 2006/0273293 | A1 | 12/2006 | Ball et al. | | |
| 2007/0006839 | A1 * | 1/2007 | Ruppel et al. | ..... | 123/179.24 |

* cited by examiner

*Primary Examiner*—Stephen K. Cronin
*Assistant Examiner*—Hyder Ali
(74) *Attorney, Agent, or Firm*—Clark & Brody

(57) ABSTRACT

An apparatus for starting an internal combustion engine having a manual recoil starter and starter rope comprises a casing that houses a motor, a source of power, a gear reducer assembly and a spool assembly. The spool assembly includes a spool that adapted to receive the handgrip of the starter rope and allow the starter rope to be wound around the spool during the starting operation. The motor via the gear reducer rotates the spool once the handgrip and cord are properly positioned and the motor is activated to pull the starter rope and start the engine.

10 Claims, 4 Drawing Sheets

HANDHELD ELECTRIC STARTER FOR ENGINES AND METHOD OF USE

This application claims priority from U.S. Patent Provisional application Nos. 60/695,530 filed on Jul. 1, 2005, and 60/811,427, filed on Jun. 7, 2006, both of which hereby incorporated by reference in their entirety.

FIELD OF THE INVENTION

The invention relates to the field of electric starters, and more specifically, to the field of electric starters for internal combustion engines that have manual recoil starters.

BACKGROUND OF THE PRIOR ART

Many different types of yard equipment are powered by small internal combustion engines that have manual recoil starters. For example, lawnmowers, chainsaws, compressors, generators, and tillers usually come equipped with a manual recoil starter. Although some of these machines also come equipped with built-in electric power starters, such as those found on larger riding lawnmowers, the manual recoil starter is a popular starter for small internal combustion engines.

To start a mower with a manual recoil starter the user initially pulls on a handgrip attached to a starter cord wound around a "one-way," or overrunning, crankshaft. When the user pulls on the cord with enough force, it causes the crankshaft to rotate fast enough to trigger the ignition system. Typically, small machines with manual recoil starters have some sort of retraction mechanism to retract the cord after the user has pulled it. Although manual recoil starters are lighter and simpler than built-in electrical starters, they can pose many problems.

Users who lack the strength to pull the starter cord with sufficient force to turn the engine over, such as disabled persons, cannot start their machines with a manual recoil starter. Further, even users with sufficient strength often lack the balance to pull recoil starters in some machines which might simultaneously require pulling the starter with one hand and operating a trigger mechanism with the other. Finally, many users might be capable of using manual recoil starters but nevertheless find them hard to pull and irritating.

Some prior devices have attempted to improve starting technology for small gas-powered engines by directly attaching electric drill-type devices to the engine's flywheel, crankshaft, or power drive. U.S. Pat. No. 3,596,647 discloses an apparatus that connects an electric drill to the flywheel, crankshaft, or power drive of an engine without disrupting the hand starter mechanism. Similarly, U.S. Pat. No. 4,615,311 discloses a combined manual and power starting device for a gasoline engine that operates by directly rotating the crankshaft of the engine.

Attaching an electric drill directly to a crankshaft requires modifying the engine to accommodate the new starting device. Such a modification might at the very least void any warranty on the originally sold machine, as well as be expensive.

Other known starters pull the engine's starter cord by utilizing a pulley housed within a bulky frame. U.S. Pat. No. 3,718,129 discloses an apparatus comprising a base frame with a motor-driven pulley on one end, a long track that extends out to the engine, and a gripping structure that grips the starter cord. U.S. Pat. No. 5,285,693 similarly discloses an auxiliary starting device with a foundation base and support post that electrically pulls the starter cord.

These inventions are inconvenient for several reasons. Somebody operating a small machine, for instance a chainsaw, in a remote location, cannot easily transport a pulley in a heavy metal frame out to the machine in the event the engine shuts off or runs out of gas. In addition, these devices must be positioned on level ground to operate correctly, despite the fact that many machines with recoil starters are used for yard work in wooded or hilly areas. Finally, these machines require a large storage space and are therefore inconvenient to store.

Yet another prior shows a starting device that attempts to simplify the starting process without directly attaching a drill to the engine or requiring a large base frame. US published application No. 2004/0244754 A1 to Smith discloses a lawnmower with a pull rope that extends from the engine and is wound onto a pulley, which is releasably engageable with the motor. In the preferred embodiment, both the pulley and the starting motor are mounted to a pair of cross bars on the handle of the lawn mower.

Attaching an electrically powered starter motor and pulley system to the handlebars of a push mower creates an unnecessary weight on the handlebars. Further, this invention does not offer much help to somebody struggling to start a device that lacks handlebars, such as a weedwacker, chain saw or generator.

SUMMARY OF THE INVENTION

The present invention offers a solution to the problems found in the prior art by providing a novel starting device for engines with manual recoil starters. A device built in accordance with the present invention will be less expensive than a drill-type device that attaches directly to the crankshaft of an engine. It is also much easier to handle than prior starter devices that have heavy foundations, frames and/or tracks. In addition, the present invention is not limited to lawnmowers. Because of its simple and lightweight design, it can easily be applied to any other type of recoil starter device, such as a chainsaw, weedwacker, generator or tiller.

In general, the present invention is a hand-held or stationary electric motor pulley system housed within a casing. Its purpose is to provide an engine starting device that is uniquely convenient to operate. The present invention is comprised of a motor, a gear reducer, clutches, pulley, housing, switch, and wiring harness.

First, the user attaches the starter device to the manual recoil starter by attaching the recoil starter's handgrip directly to a recess in the device's pulley. The device can be held in the hand or braced against the frame of the machine. For instance, if the user wants to start a push lawnmower, the user can brace the casing against the circular blade frame of the mower.

Alternatively, if the user desires to permanently fix the casing to a machine for easy starting, the user can employ any number of ways to attach it, for instance by screwing the casing to the engine's frame, using a metal brace to attach the casing to the engine, or using any kind of fastener device. Of course, the user could also construct a fastener that allows the user to temporarily brace the casing against the machine during the starting process, and then remove the invention after starting. The user can stand, crouch, kneel, or position himself or herself in any number of ways to use starter device.

Once the user has attached the handgrip to the recess in the device's pulley, the user pushes a switch which starts an electric motor within the casing. A gear reducer lowers the motor's high RPM down to a lower RPM that is designed to pull a starter cord fast enough and powerfully enough to start the engine.

After the invention fully extends the starter cord, the slip clutch allows the pulley to stop rotating. The user then reverses the control switch whereby the pulley reverses direction so that the engine can rewind the starter cord. At that point, the user may disconnect the device, if the engine has started, or activate the device again to make a further attempt to start the engine.

It is therefore one object of this invention to provide a starting device for recoil starter engines that can be quickly attached to and released from the starter cord's handgrip.

It is another object of this invention to provide a starting device for recoil starter engines that is compact and hand-held, making it easy to carry around or easy to attach to an engine's frame.

DETAILED DESCRIPTION OF THE DRAWINGS

Referring now to FIGS. 1-5, the preferred embodiment of the present invention is a compact, hand-held electric starter device. While the preferred embodiment is meant to be used as a portable device, it is contemplated that this apparatus can also be used in a stationary way, for instance, by permanently or temporarily attaching the apparatus to the frame of a lawnmower. Its lightweight and compact design enables the user to employ it in a variety of ways, ranging from purely portable use to permanently fixed use.

Figure 1:
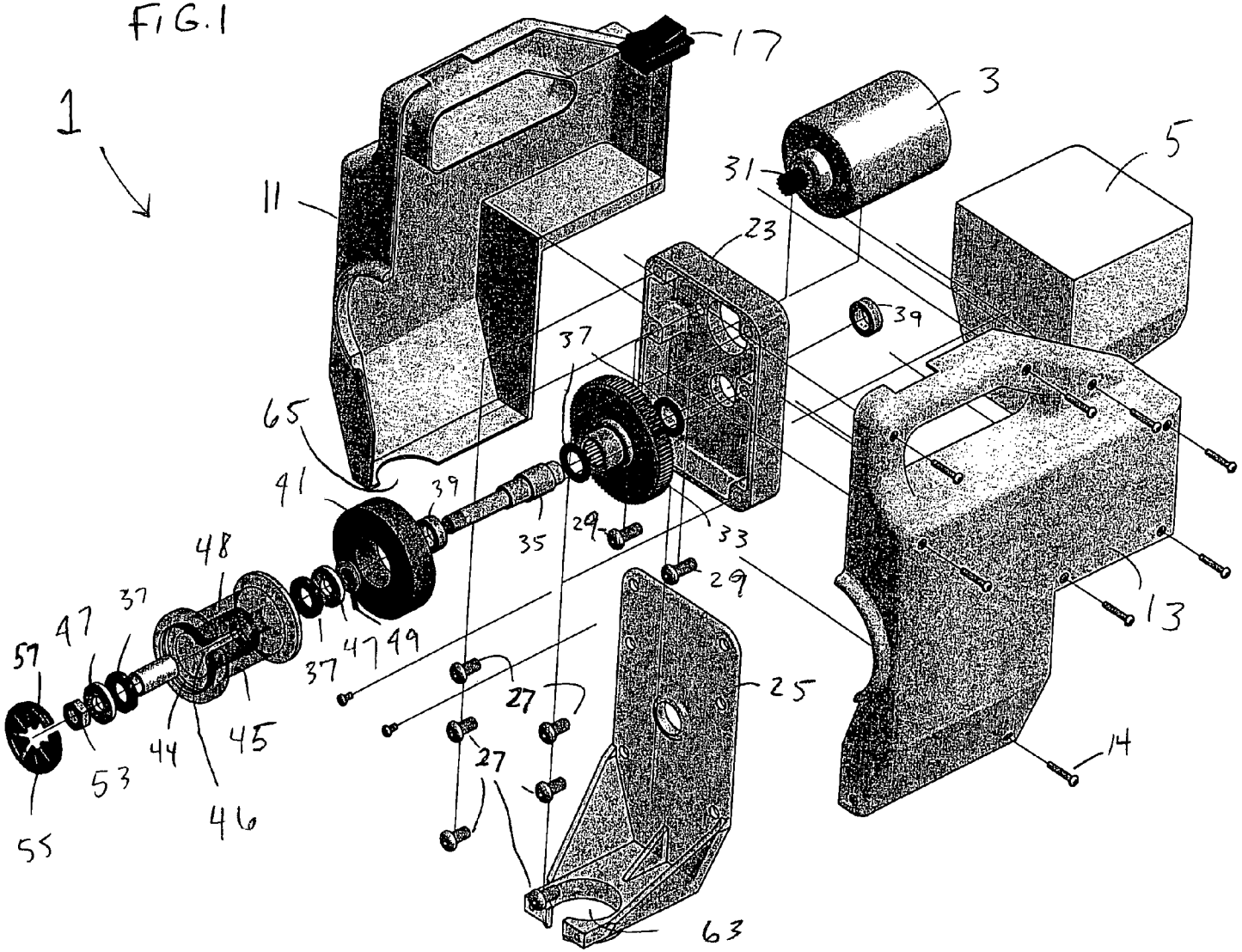
FIG. 1 is an exploded view of the various parts within the housing of one embodiment of the invention.

FIG. 1 illustrates an exploded view of one embodiment of the starter device of the invention which is designated by the reference numeral 1. The device 1 has a casing 10 comprising two halves 11 and 13 and fasteners 14 that house all of the components of the starter device, including a motor 3, a battery 5, a gear reducer assembly 7 and a spool assembly 9. On the outside of the casing 10 is an ergonomically curved handle 15 for the user to hold when using the present invention to pull a starter rope. It should be understood that the casing 10 and handle 15 can be any type, size, shape or style, but are preferably be made out of a lightweight and durable material such as a known plastic.

Figure 3:
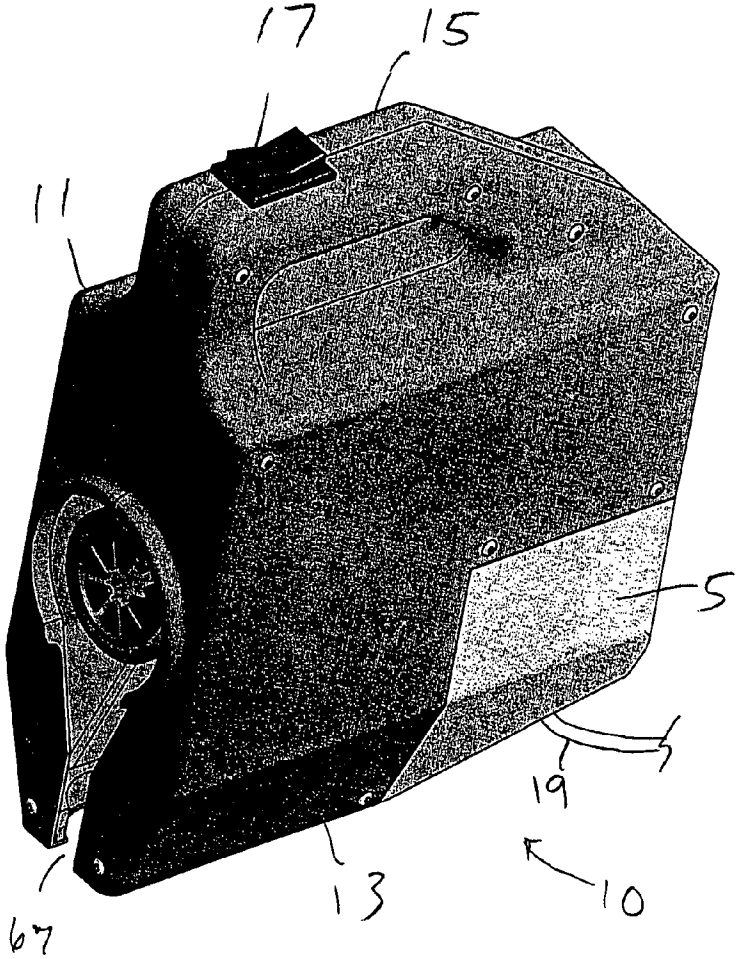
FIG. 3 is a perspective view of a casing for the device of FIG. 1.
Figure 2:
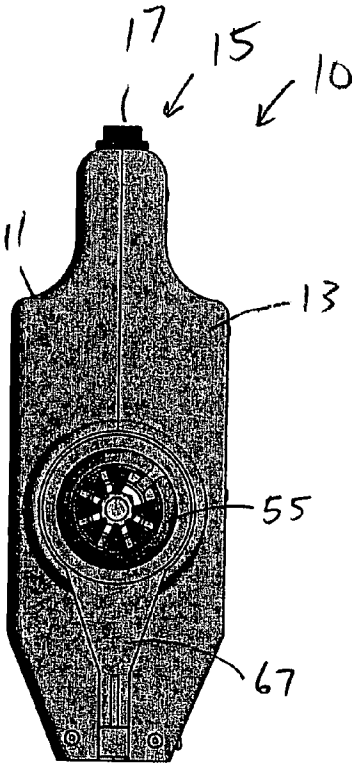
FIG. 2 is a front view of a casing for the device of FIG. 1.
Figure 4:
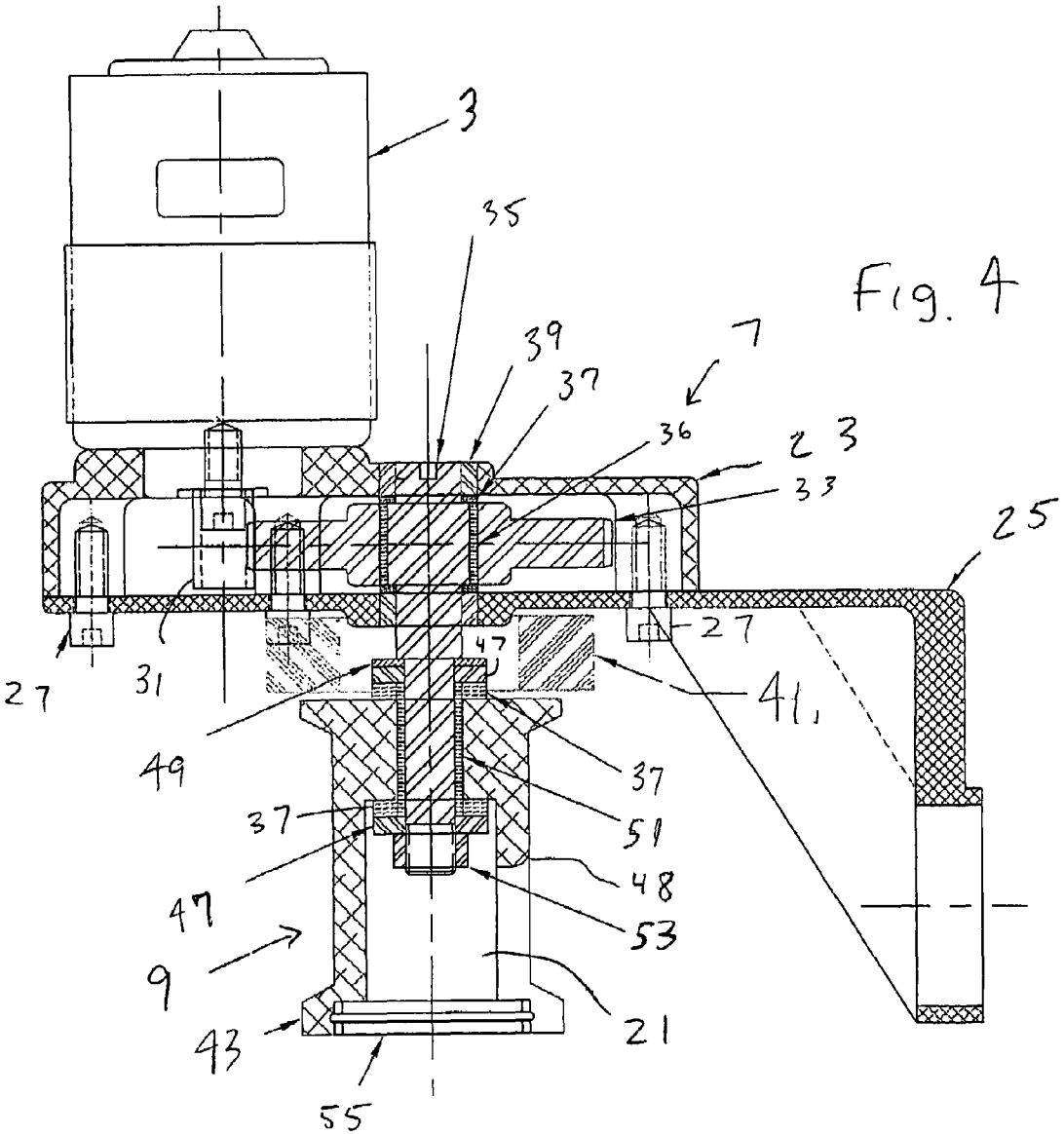
FIG. 4 is a sectional view of motor, gear reducer assembly and spool assembly of the device of FIG. 1.

A switch 17 is positioned on or closely adjacent to the handle 15 for easy access by a user's finger to activate the device. In order to power the device, the casing will accommodate a source of electrical power, either the battery 5 or via a power cord 19 as shown in FIG. 3. For simplicity purposes, the wiring necessary to operate the motor in conjunction with the switch 17 is not shown.

The gear reducer assembly 7 comprises a housing 23 and front plate 25 that are attached together using fasteners 27. The motor 3 is mounted to the housing 23 using fasteners 29. The motor 3 has a gear 31 adapted to engage teeth on the reducer gear 33. The reducer gear 33 is mounted on a shaft 35 using bearing 36, fiber washers 37 and brass bushings 39. The reducer gear 33 rotates as a result of its engagement with the motor gear 31.

The shaft 35 extends from the front plate 25 to interface with the spool assembly 9. The spool assembly 9 includes a foam rubber spacer 41 positioned between the plate 25 and spool 43. The spool 43 is centrally mounted on the shaft 35 using brass bushing 51, and also mounted on one end adjacent the gear reducer assembly 7 using fiber washer 37, flat washer 47, and pressure washer 49. On the other end of the spool 43, it is held in place using fiber washer 37, flat washer 47 and hex nut 53. The combination of the nut 53, flat washer 47 and fiber washer 37, and the combination of the pressure washer 49, flat washer 47 and fiber washer 37 acts as a mechanical slip clutch 6 to allow the spool to slip in response to a given torque as is described below.

Figure 5:
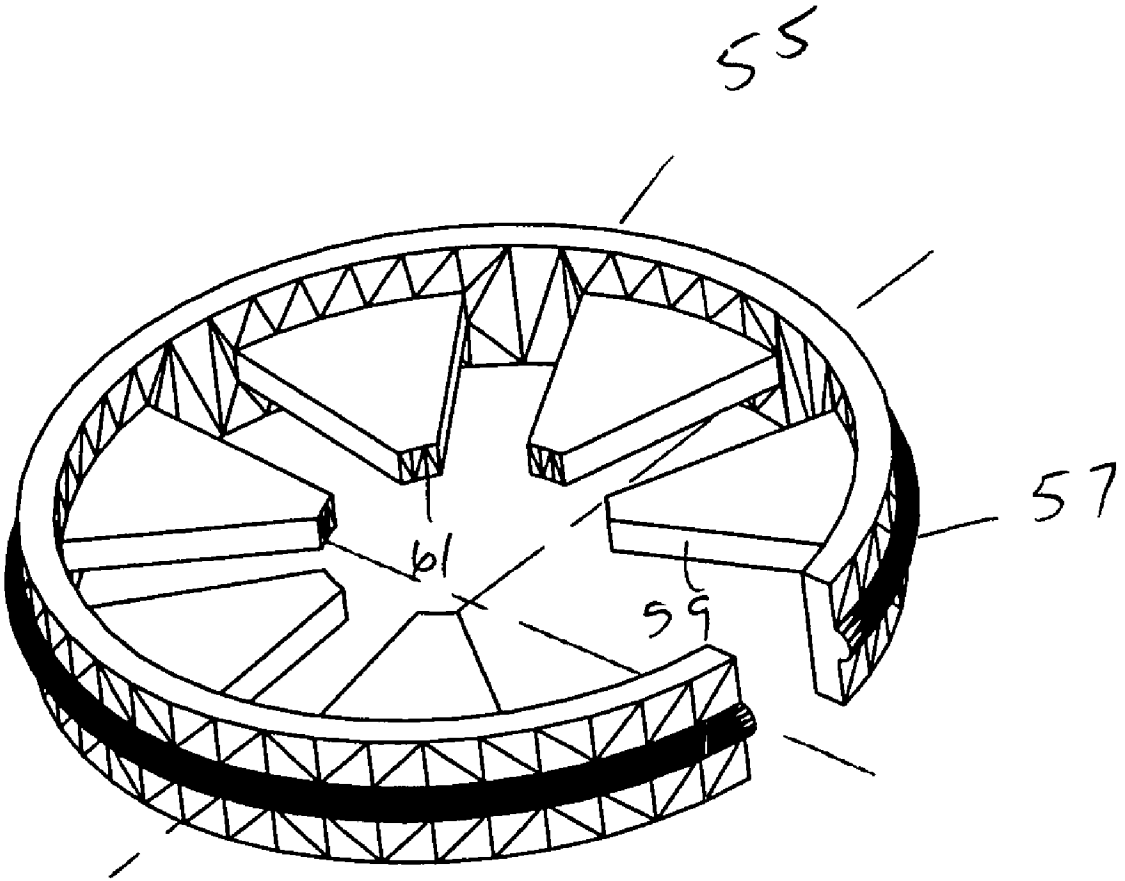
FIG. 5 is a perspective view of the spool finger insert of the device of FIG. 1.

Referring to FIGS. 1 and 5, a spool finger insert 55 is fit to the opening 44 of the spool 43 using a gasket 57. Flexible fingers 59 extend within a periphery of the insert 55, with surfaces 61 adapted to grip the handgrip of an engine starter cord when the handgrip is disposed within a recess 21 of the spool 43. The fingers 59 aid in holding the handgrip in place during the starting operation. While flexible fingers are used a gripping means for holding the handgrip in place, other types of gripping means could be employed, e.g., employing friction material on the inside of the spool to secure the handgrip. Alternatively, the gripping means could be eliminated, with the handgrip merely placed inside the spool recess for winding purposes.

The spool 43 also has a slot 46 which allows the cord of the handgrip to pass therethrough when the handgrip is in the recess 21 so that when the spool rotates, the cord will wrap around the exterior surface 48 of the spool 43.

Initially, the user will need to place the handgrip of the starter cord in the recess 21 of the spool 43. The front plate 25 has an opening 63 which cooperates with a complementary opening 65 in the casing 10 and a slot 67 in the front face of the casing 10. The openings and the slot provide a path for the starter cord when the handgrip is inserted in the spool. The recess 21 is configured to receive the handgrip and align the starter cord with the spool in such a way that when the spool 43 rotates, both the starter cord and the handgrip will be smoothly and quickly wound up onto the spool. The openings 63 and 65 also allow the cord of the engine to be started to be aligned with the spool for accurate winding by movement of the casing 10. The spool surface 48 and surrounding space in the casing 10 provides an ample amount of space to accommodate a fully wound starter cord of conventional length and thickness. It should be understood that the opening and slot arrangement is one example of providing communication between the handgrip and cord of the engine to be started and the spool, and other configurations could be employed that would provide access to the spool, e.g., just one opening in the casing rather than the combination of two openings as a slot and round hole.

Referring back to FIG. 1, the motor 3 is turned on or off by depressing or releasing the switch 17. Once the user depresses the switch, power from the battery 5 (or electric cord if used) rotates the motor 3. The motion of the motor is then transferred from the motor 5 into a gear reducer assembly 7. While a particular gear reducer is illustrated, the gear reducer can be any type or style, with any number of stages. For example, gear reducer having a reduction ratio such as 85:1, 10:1, or others may be used to reduce the rotational velocity of a motor, e.g., a permanent-magnet motor, from about 20,000 RPM to about 2000 RPM. Other satisfactory combinations of gear reducers and electric motors will be apparent to those of skill in the art.

The output of the gear reducer is transferred from output shaft 35 to the spool assembly 9. When the recoil starter on the engine is fully extended such that the cord is wrapped around the spool 43, the slip clutch 6 will slip to prevent further application of force to the cord. When the slip clutch 6 slips, the switch 17 can be released by the user, stopping motion on the starter device. At this point, the spool 45 has fully extended the starter cord and handgrip from the engine and wound it up into the casing 10. Although a mechanical slip clutch is shown, an electronic clutch or any other type of clutch mechanism could be employed with the starter device.

When the switch 17 is reversed, the counter-directional force caused by the engine's recoil starter will cause the clutch to release. When the directional clutch releases, the spool 45 will be turned in reverse by the engine recoil starter, allowing the engine recoil cord to reset for another pull by the starter device. At this point, the engine has retracted the starter cord back into the engine, out of the casing 10. If the engine has started, the user can detach the starter cord's handgrip from the spool 45. If the engine has not started, the user can simply push the switch 17 and start the process over again, until the engine has started.

The internal components of the casing that wind the starter cord of the engine to be started are considered a means for pulling the manual recoil starter of the engine.

The invention can be modified in various ways. It should be understood that the terminology which has been used is intended to be in the nature of words of description rather than of limitation. Many modifications and variations of the invention are possible in light of the above teachings. These and other modifications, which will be apparent to those skilled in the art, should be considered within the spirit and scope of the following claims.

I claim:

1. An apparatus for starting an internal combustion engine having a manual recoil starter and a starter rope, comprising:

a casing having a handle protruding from a wall portion of the casing, the handle sized to permit the casing to be carried to the internal combustion engine for starting, and an electric motor means for pulling said manual recoil starter to start said internal combustion engine wherein said electric motor means for pulling is carried in said casing.

2. The apparatus of claim 1 wherein said electric motor means for pulling comprises:

an electric motor, a gear reducer operatively connected to the said electric motor, a spool connected to said gear reducer, and a recess in said spool for removably receiving a handgrip of said starter rope.

3. The apparatus of claim 2 wherein said electric motor means for pulling is further comprised of:

an output shaft operatively connected to said gear reducer, and a slip clutch operatively connected to said output shaft.

4. The apparatus of claim 1, wherein the easing has at least one opening to receive a handgrip of the internal combustion engine.

5. The apparatus of claim 2, wherein the spool includes means for gripping the handgrip.

6. The apparatus of claim 2, wherein the electric motor is powered by a battery.

7. A method for starting an internal combustion engine having a manual recoil starter, a starter rope, and a handgrip linked to the starter rope, the method comprising the steps of;

attaching the handgrip of the starter rope to a portion of an electric motor pulling means, wherein the electric motor pulling means is supported by a casing having a handle that protrudes from a wall portion of the casing, the casing sized to be portable and hand held using the handle; and activating the pulling means so that the pulling means pulls the handgrip to start the internal combustion engine.

8. The method of claim 7, wherein the activating step includes pressing or releasing a switch in the case.

9. A device for starting an internal combustion engine, wherein the internal combustion engine includes a manual recoil starter, a starter rope, and a handgrip linked to the starter rope, the device comprising:

a casing having a handle, the handle protruding from a wall portion of the casing, the casing sized to be portable and hand held using the handle; and electric motor means for pulling the handgrip of the manual recoil starter to start the internal combustion engine, wherein the electric motor means for pulling is supported by the casing.

10. The device of claim 9, wherein the electric motor means for pulling includes a notch for securing the handgrip during pulling.

* * * * *